US009780466B1

(12) United States Patent
Chang et al.

(10) Patent No.: US 9,780,466 B1
(45) Date of Patent: Oct. 3, 2017

(54) RJ CONNECTOR ASSEMBLY

(71) Applicant: U.D.ELECTRONIC CORP., Taoyuan (TW)

(72) Inventors: Chih-Kai Chang, Taoyuan (TW); Bin Zeng, Taoyuan (TW); Yao-Ching Huang, Taoyuan (TW)

(73) Assignee: U.D.ELECTRONIC CORP., Taoyuan (TW)

( * ) Notice: Subject to any disclaimer, the term of this patent is extended or adjusted under 35 U.S.C. 154(b) by 0 days.

(21) Appl. No.: 15/456,576

(22) Filed: Mar. 13, 2017

(51) Int. Cl.
*H01R 12/52* (2011.01)
*H01R 13/6466* (2011.01)
*H01R 24/64* (2011.01)
*H01R 107/00* (2006.01)

(52) U.S. Cl.
CPC ..... *H01R 12/523* (2013.01); *H01R 13/6466* (2013.01); *H01R 24/64* (2013.01); *H01R 2107/00* (2013.01)

(58) Field of Classification Search
CPC ..... H01R 24/64; H01R 12/523
See application file for complete search history.

(56) References Cited

U.S. PATENT DOCUMENTS 6,191,954 B1 * 2/2001 Keidl ..... H05K 1/0243 174/138 G
6,533,587 B1 * 3/2003 Potter ..... G06F 1/184 257/E23.099
7,442,055 B2 * 10/2008 Robinette ..... H01R 12/724 439/541.5
2004/0087217 A1 * 5/2004 Hyland ..... H01R 13/65802 439/676
2007/0064402 A1 * 3/2007 Schumacher ..... H01R 12/58 361/785
2008/0171454 A1 * 7/2008 Liu ..... H01R 12/58 439/74
2008/0248684 A1 * 10/2008 Filipon ..... H01R 13/6658 439/485
2008/0305692 A1 * 12/2008 Little ..... H01R 13/6658 439/676
2010/0068904 A1 * 3/2010 Henry ..... H01R 13/514 439/81
2012/0142199 A1 * 6/2012 Purkis ..... H01R 24/64 439/39
2014/0120771 A1 * 5/2014 Tai ..... H01R 12/52 439/607.38
2014/0256185 A1 * 9/2014 Fransen ..... H01R 13/6461 439/626
2015/0011131 A1 * 1/2015 Zhou ..... H01R 13/518 439/694

* cited by examiner

*Primary Examiner* — James Harvey

(57) ABSTRACT

A RJ connector assembly having the characteristics of simple structural design, effective and rational use of space and compact structure is disclosed to include an input PCB module including an input PC board and two RJ modular terminal blocks bonded to two opposite sides of the input PC board, an output PCB module including an output PC board disposed in parallel to the input PC board and an output interface located on the output PC board, and a connecting PCB module including a connecting PC board with a top side thereof electrically bonded to the input PC board and an opposing bottom side thereof electrically bonded to the output PC board.

11 Claims, 5 Drawing Sheets

RJ CONNECTOR ASSEMBLY

BACKGROUND OF THE INVENTION

1. Field of the Invention

The present invention relates to electrical connector technology and more particularly, to an RJ connector assembly.

2. Description of the Related Art

A conventional RJ-45 connector mounting connection structure generally comprises two filter modules, a mask piece and an input PC board. The mask piece is set between the two filter modules. The input PC board is mounted at the top side of the two filter modules, and bonded with the modular terminals of the filter modules. In installation, the worker needs to arrange the lead wires of the coil winding packs of the filter modules manually for bonding to the input terminals and the modular terminals. Thus, this conventional design is not conducive to the realization of fully automated production.

SUMMARY OF THE INVENTION

The present invention has been accomplished under the circumstances in view. It is therefore the main object of the present invention to provide an RJ connector assembly, which is conducive to the realization of fully automated production, improving the production efficiency and reducing the manufacturing cost.

To achieve this and other objects of the present invention, an RJ connector assembly comprises an input PCB module, an output PCB module, and a connecting PCB module electrically connected between the input PCB module and the output PCB module. The input PCB module comprises an input PC board, and at least one RJ modular terminal block bonded to the input PC board. The output PCB module is disposed at a bottom side in a parallel manner relative to the input PCB module, comprising an output PC board disposed in parallel to the input PC board and output interface means located on the output PC board. The connecting PCB module comprises a connecting PC board. The connecting PC board has a top side thereof electrically bonded to the input PC board, and an opposing bottom side thereof electrically bonded to the output PC board.

DETAILED DESCRIPTION OF THE PREFERRED EMBODIMENT

Figure 1:
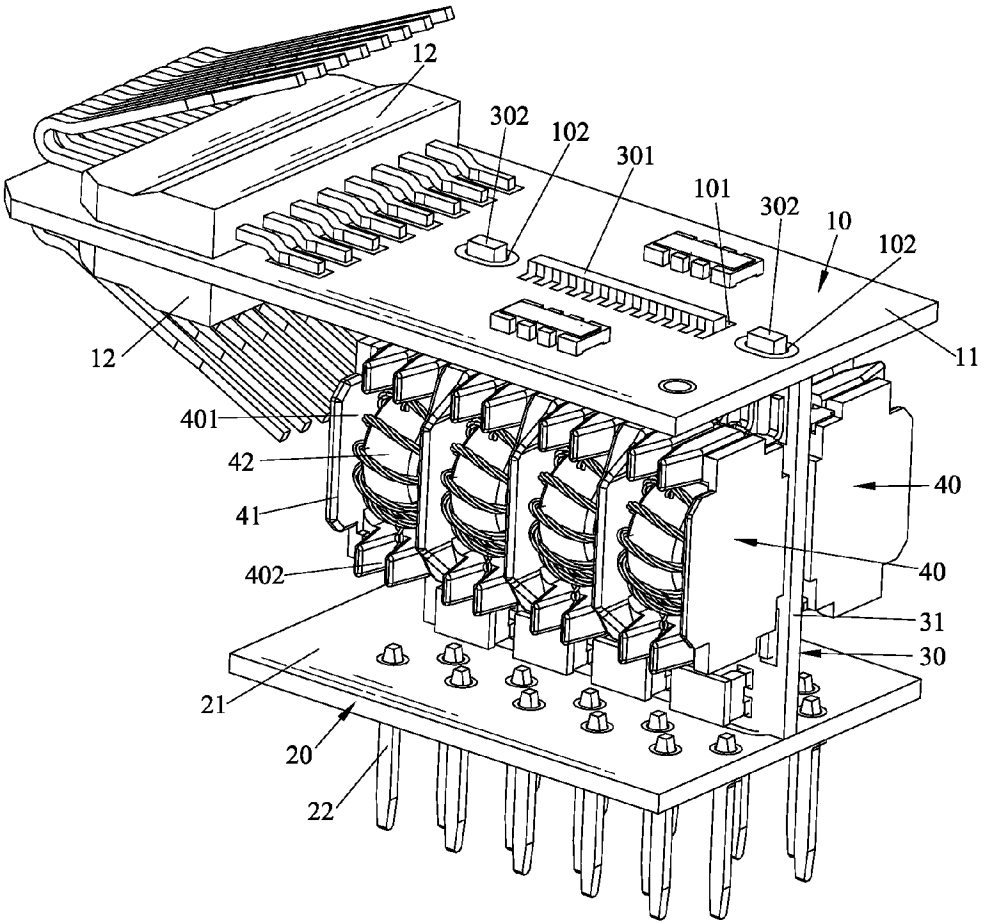
FIG. 1 is an oblique top elevational view of an RJ connector assembly in accordance with a first embodiment of the present invention.
Figure 2:
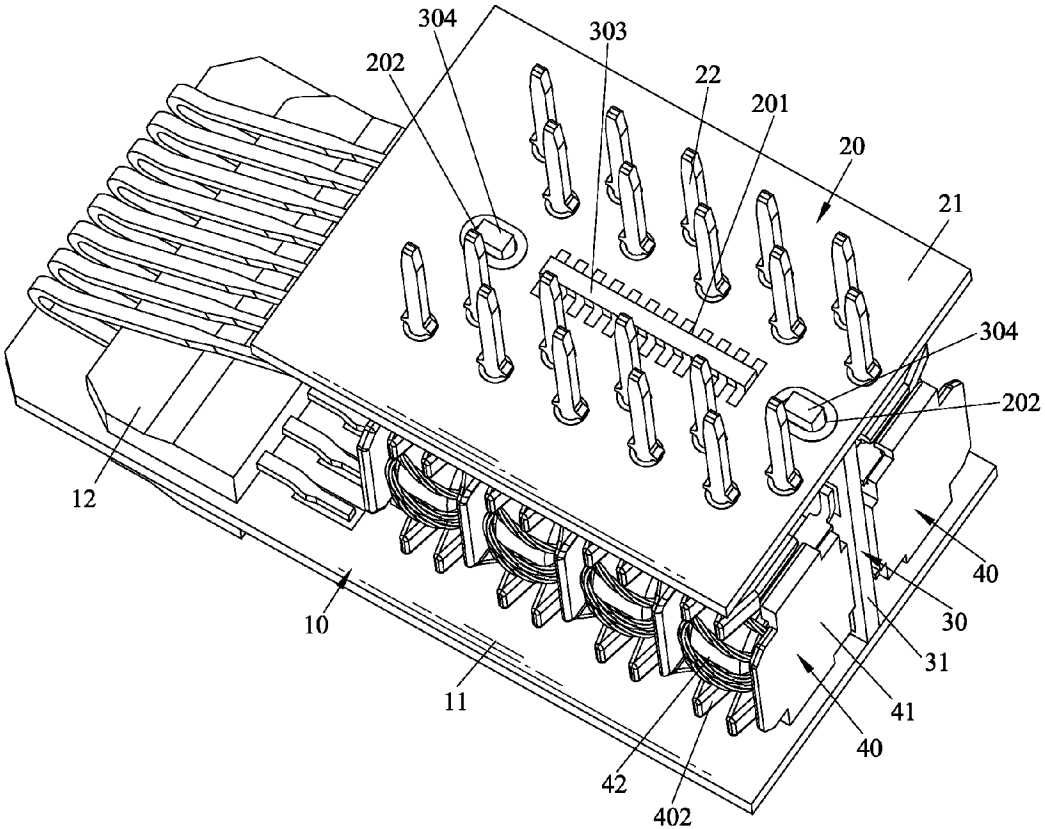
FIG. 2 is an oblique bottom elevational view of the RJ connector assembly in accordance with the first embodiment of the present invention.
Figure 3:
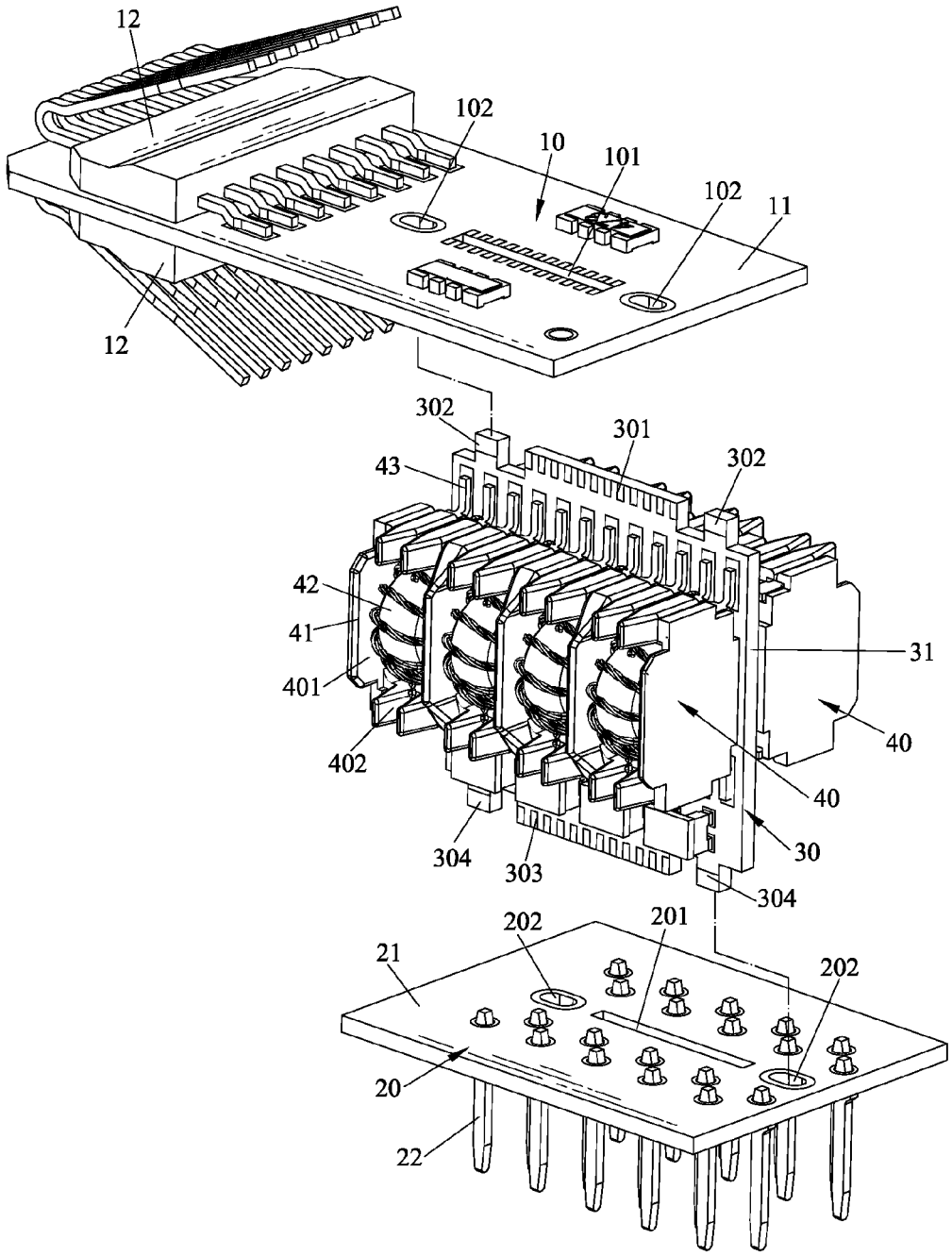
FIG. 3 is an exploded view of the RJ connector assembly in accordance with the first embodiment of the present invention.

Referring to FIGS. 1-3, an RJ connector assembly in accordance with a first embodiment of the present invention is shown. The RJ connector assembly comprises an input PCB module 10, an output PCB module 20, and a connecting PCB module 30 electrically connected between the input PCB module 10 and the output PCB module 20.

The input PCB module 10 comprises an input PC board 11, and at least one an RJ modular terminal block 12 bonded to the input PC board 11. In this embodiment, two RJ modular terminal blocks 12 are respectively bonded to opposing top and bottom surfaces of the input PC board 11. Further, electronic components (not shown), such as high voltage capacitor or TVS tube (transient suppression diode), etc. are mounted on the input PC board 11 to meet electrical requirements.

The output PCB module 20 is disposed at the bottom side of the input PCB module 10, comprising an output PC board 21 disposed in parallel to the input PC board 11 and output interface means 22 mounted at the output PC board 21.

The connecting PCB module 30 comprises a connecting PC board 31. The connecting PC board 31 is electrically bonded with a top side thereof to the input PC board 11 and electrically bonded with an opposing bottom side thereof to the output PC board 21. Further, electronic components (not shown), such as high voltage capacitor or TVS tube (transient suppression diode), etc. are mounted on the output PC board 21 to meet electrical requirements.

Further, the input PC board 11 comprises a top bonding groove 101 and two top bonding holes 102. The two top bonding holes 102 are respectively disposed near two opposite ends of the top bonding groove 101 and kept in line with the top bonding groove 101. The connecting PC board 31 comprises a top positioning rib 301 and two top positioning protrusions 302 respectively located at a top side thereof. The top positioning rib 301 is plugged into the top bonding groove 101 and electrically bonded thereto. The two top positioning protrusions 302 are respectively engaged into the top bonding holes 102 and bonded thereto. The output PC board 21 comprises a bottom bonding groove 201 and two bottom bonding holes 202. The two bottom bonding holes 202 are respectively disposed near two opposite ends of the bottom bonding groove 201 and kept in line with the bottom bonding groove 201. The connecting PC board 31 further comprises a bottom positioning rib 303 and two bottom positioning protrusions 304 respectively located at an opposing bottom side thereof. The bottom positioning rib 303 is plugged into the bottom bonding groove 201 and electrically bonded thereto. The two bottom positioning protrusions 304 are respectively engaged into the bottom bonding holes 202 and bonded thereto. The connecting PC board 31 has an inner copper clad, forming a mask layer (not shown) to mask the two opposite sides of the connecting PC board 31. Further, two filter modules 40 are respectively bonded to two opposite sides of the connecting PC board 31. Each filter module 40 comprises a plastic holder base 41, a plurality of coil winding packs 42 mounted in the plastic holder base 41 in a separated manner, and a plurality of connection terminals 43 integrally molded in the plastic holder base 41 and electrically bonded to the connecting PC board 31. The plastic holder base 41 has a plurality of accommodation chambers 401 defined therein, and a plurality of wire grooves 402 located at two opposite lateral sides thereof. The coil winding packs 42 are respectively mounted in the accommodation chambers 401 with the lead wires thereof set in the respective wire grooves 402 and bonded to the respective connection terminals 43. The output interface means 22 is a set of output terminals bonded to the bottom surface of the output PC board 21 and vertically downwardly extended from the bottom surface of the output PC board 21 for bonding to respective via holes of an external circuit board.

In installation, bond the two filter modules 40 to the two opposite surfaces of the connecting PC board 31, and then bond the RJ modular terminal block 12 to the input PC board 11, and then insert the top positioning rib 301 into the top bonding groove 101 and electrically bond the respective contacts (not shown) in the top positioning rib 301 and the respective contacts (not shown) in the top bonding groove 101 together, and then insert the two top positioning protrusions 302 into the respective top bonding holes 102 and bond them together, and then insert the bottom positioning rib 303 into the bottom bonding groove 201 and electrically bond the respective contacts (not shown) in the bottom positioning rib 303 and the respective contacts (not shown) in the bottom bonding groove 201 together, and then insert the two bottom positioning protrusions 304 into the respective bottom bonding holes 202 and bond them together.

Figure 4:
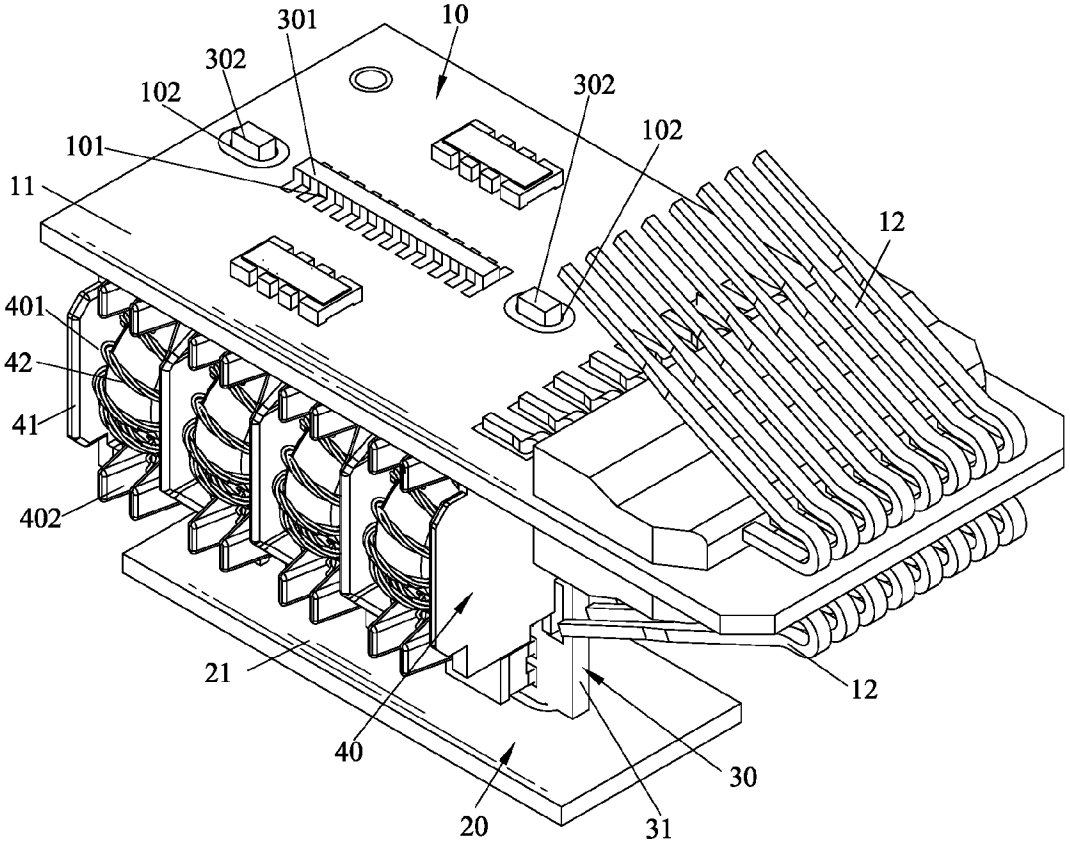
FIG. 4 is an oblique top elevational view of an RJ connector assembly in accordance with a second embodiment of the present invention.
Figure 5:
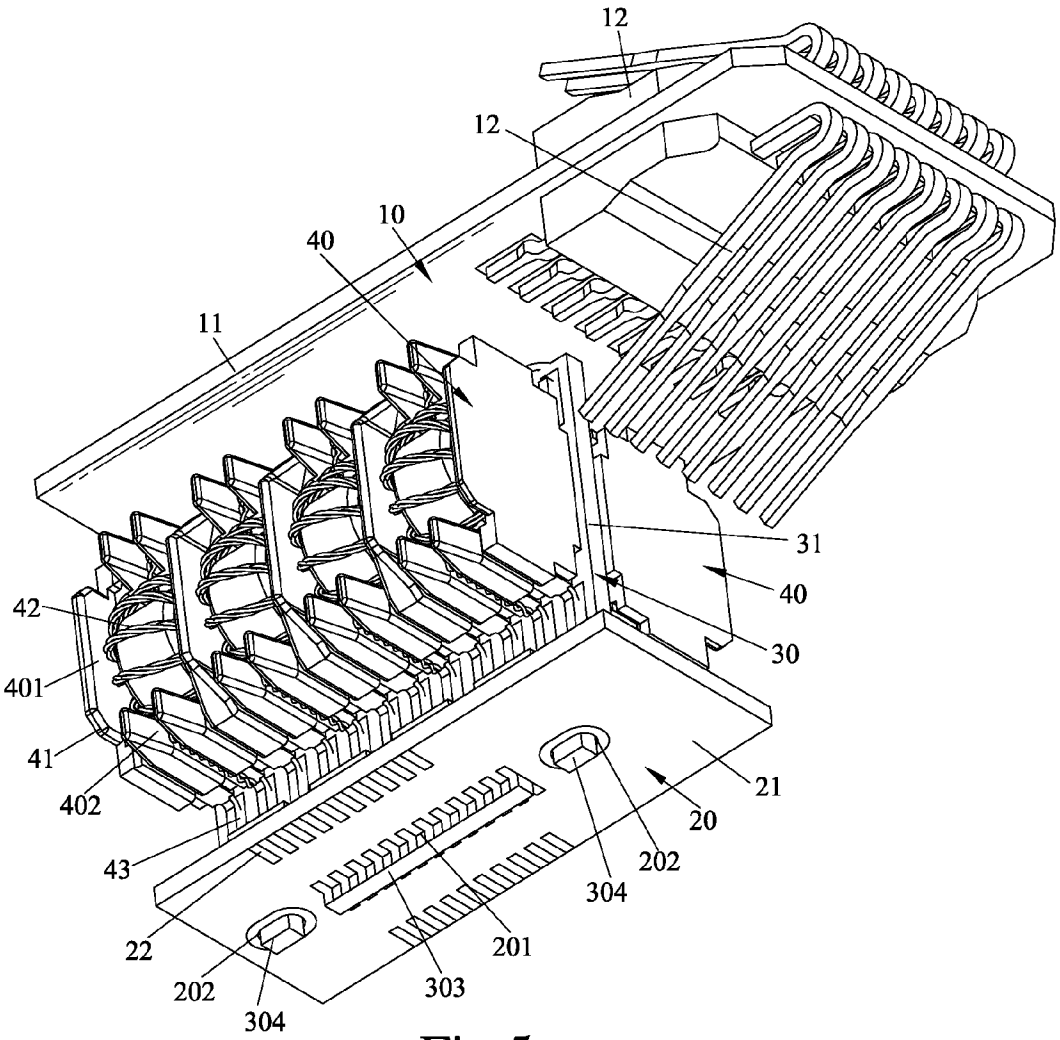
FIG. 5 is an oblique bottom elevational view of the RJ connector assembly in accordance with the second embodiment of the present invention.

Referring to FIGS. 4 and 5, an RJ connector assembly in accordance with a second embodiment of the present invention is shown. This second embodiment is substantially similar to the aforesaid first embodiment with the exception that the output interface means 22 is comprised of a plurality of output solder pads arranged on the bottom surface of the output PC board 21 for electrically bonding to an external circuit board.

In general, the invention utilizes the arrangement of electrically connecting the connecting PCB module 30 between the input PCB module 10 and the output PCB module 20 instead of the conventional filter module connection measure. In the fabrication of the RJ connector assembly, it is unnecessary to arrange electrical wires. The RJ connector assembly of the present invention is conducive to the realization of fully automated production, improving the production efficiency and reducing the manufacturing cost. The RJ connector assembly eliminates the use of module terminals and a mask piece, reducing mold costs. Further, the RJ connector assembly of the present invention has the characteristics of simple structural design, effective and rational use of space and compact structure.

What the invention claimed is:

1. An RJ connector assembly, comprising an input PCB module, an output PCB module and a connecting PCB module electrically connected between said input PCB module and said output PCB module, wherein:

said input PCB module comprises an input PC board and at least one RJ modular terminal block bonded to said input PC board;

said output PCB module is disposed at a bottom side in a parallel manner relative to said input PCB module, comprising an output PC board disposed in parallel to said input PC board and output interface means located on said output PC board;

said connecting PCB module comprises a connecting PC board, said connecting PC board having a top side thereof electrically bonded to said input PC board and an opposing bottom side thereof electrically bonded to said output PC board.

2. The RJ connector assembly as claimed in claim 1, wherein said input PC board of said input PCB module comprises a top bonding groove and two top bonding holes respectively disposed near two opposite ends of said top bonding groove and kept in line with said top bonding groove; said connecting PC board of said connecting PCB module comprises a top positioning rib plugged into said top bonding groove and electrically bonded thereto, and two top positioning protrusions respectively engaged into said top bonding holes and bonded thereto.

3. The RJ connector assembly as claimed in claim 1, wherein said output PC board of said output PCB module comprises a bottom bonding groove and two bottom bonding holes respectively disposed near two opposite ends of said bottom bonding groove and kept in line with said bottom bonding groove; said connecting PC board of said connecting PCB module comprises a bottom positioning rib plugged into said bottom bonding groove and electrically bonded thereto, and two bottom positioning protrusions respectively engaged into the respective said bottom bonding holes and bonded thereto.

4. The RJ connector assembly as claimed in claim 1, wherein said connecting PCB module further comprises two filter modules respectively bonded to two opposite sides of said connecting PC board, each said filter module comprising a plastic holder base, a plurality of coil winding packs mounted in said plastic holder base in a separated manner, and a plurality of connection terminals integrally molded in said plastic holder base and electrically bonded to said connecting PC board, said plastic holder base comprising a plurality of accommodation chambers defined therein, and a plurality of wire grooves located at two opposite lateral sides thereof corresponding to the respective said accommodation chambers, said coil winding packs being respectively mounted in the respective said accommodation chambers with respective lead wires thereof set in the respective said wire grooves and bonded to the respective said connection terminals.

5. The RJ connector assembly as claimed in claim 1, wherein said connecting PC board of said connecting PCB module comprises an inner copper clad, forming a mask layer.

6. The RJ connector assembly as claimed in claim 1, wherein said output interface means of said output PCB module consists of a plurality of output terminals bonded to a bottom surface of said output PC board and vertically downwardly extended from the said bottom surface of said output PC board.

7. The RJ connector assembly as claimed in claim 1, wherein said output interface means of said output PCB module consists of a plurality of output solder pads located on a bottom surface of said output PC board.

8. The RJ connector assembly as claimed in claim 1, wherein said input PCB module further comprises at least one high voltage capacitor mounted on said input PC board.

9. The RJ connector assembly as claimed in claim 1, wherein said input PCB module further comprises at least one TVS tube (transient suppression diode) mounted on said input PC board.

10. The RJ connector assembly as claimed in claim 1, wherein said output PCB module further comprises at least one high voltage capacitor mounted on said output PC board.

11. The RJ connector assembly as claimed in claim 1, wherein said output PCB module further comprises at least one TVS tube (transient suppression diode) mounted on said output PC board.

* * * * *